US008752362B2

(12) United States Patent
Kraemer et al.

(10) Patent No.: US 8,752,362 B2
(45) Date of Patent: Jun. 17, 2014

(54) OPTICAL FLAME HOLDING AND FLASHBACK DETECTION

(75) Inventors: Gilbert Otto Kraemer, Greer, SC (US); Jonathan Dwight Berry, Simpsonville, SC (US); Lewis Berkley Davis, Jr., Niskayuna, NY (US); Garth Curtis Frederick, Greenville, SC (US); Anthony Wayne Krull, Anderson, SC (US); Geoffrey David Myers, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1002 days.

(21) Appl. No.: 12/354,010

(22) Filed: Jan. 15, 2009

(65) Prior Publication Data

US 2010/0175384 A1 Jul. 15, 2010

(51) Int. Cl.
*F02G 3/00* (2006.01)

(52) U.S. Cl.
USPC ..... 60/39.091; 60/39.11; 60/779; 250/372

(58) Field of Classification Search
USPC ..... 60/793–39.3, 732, 733, 803, 779; 250/372
See application file for complete search history.

(56) References Cited

U.S. PATENT DOCUMENTS

| | | | | |
|---|---|---|---|---|
| 3,667,218 | A | | 6/1972 | Davis |
| 3,811,816 | A | | 5/1974 | Whitman |
| 3,840,341 | A | | 10/1974 | Rogers |
| 3,920,376 | A | | 11/1975 | Wyland |
| 4,081,215 | A | | 3/1978 | Penney et al. |
| 5,120,975 | A | | 6/1992 | Fedor et al. |
| 5,257,496 | A | | 11/1993 | Brown et al. |
| 5,303,684 | A | | 4/1994 | Brown et al. |
| 5,487,266 | A | * | 1/1996 | Brown ..... 60/776 |
| 5,544,478 | A | * | 8/1996 | Shu et al. ..... 60/773 |
| 5,578,828 | A | | 11/1996 | Brown et al. |
| 5,722,230 | A | | 3/1998 | Cohen et al. |
| 5,755,819 | A | | 5/1998 | Bonanni et al. |
| 5,857,320 | A | | 1/1999 | Amos et al. |
| 5,924,275 | A | | 7/1999 | Cohen et al. |
| 6,013,919 | A | | 1/2000 | Schneider et al. |
| 6,071,114 | A | | 6/2000 | Cusack et al. |

(Continued)

FOREIGN PATENT DOCUMENTS

| | | | |
|---|---|---|---|
| JP | 6212823 | A | 1/1987 |
| JP | 04186014 | A | 7/1992 |

(Continued)

OTHER PUBLICATIONS

Brown et al., Experience Using Flame Tracker(TM) Silicon Carbide Ultraviolet Flame Detectors in Gas Turbine Engines; Orbit [vol. 25 No. 1], 2005; pp. 77-83.

(Continued)

*Primary Examiner* — Gerald L Sung
*Assistant Examiner* — Craig Kim
(74) *Attorney, Agent, or Firm* — Cantor Colburn LLP

(57) ABSTRACT

Optical flame holding and flashback detection systems and methods are provided. Exemplary embodiments include a combustor including a combustor housing defining a combustion chamber having combustion zones, flame detectors disposed on the combustor housing and in optical communication with the combustion chamber, wherein each of the flame detectors is configured to detect an optical property related to one or more of the combustion zones.

20 Claims, 6 Drawing Sheets

(56) References Cited

U.S. PATENT DOCUMENTS

| | | | | |
|---|---|---|---|---|
| 6,239,434 | B1 | 5/2001 | Brown | |
| 6,350,988 | B1 | 2/2002 | Brown | |
| 6,389,330 | B1 | 5/2002 | Khesin | |
| 6,599,028 | B1 | 7/2003 | Shu et al. | |
| 6,646,265 | B2 | 11/2003 | Brown et al. | |
| 6,655,145 | B2 | 12/2003 | Boardman | |
| 6,768,326 | B2 | 7/2004 | Brown et al. | |
| 6,784,430 | B2 | 8/2004 | Matocha et al. | |
| 6,818,897 | B2 | 11/2004 | Brown | |
| 7,112,796 | B2 | 9/2006 | Brown et al. | |
| 7,281,382 | B2 * | 10/2007 | Plimpton et al. | 60/779 |
| 7,285,433 | B2 | 10/2007 | Kretchmer et al. | |
| 7,334,413 | B2 | 2/2008 | Myhre | |
| 2007/0012965 | A1 | 1/2007 | Sandvik et al. | |
| 2007/0119147 | A1 | 5/2007 | Cornwell et al. | |
| 2008/0016877 | A1 | 1/2008 | Miller et al. | |
| 2008/0083228 | A1 | 4/2008 | Myhre | |

FOREIGN PATENT DOCUMENTS

| | | | |
|---|---|---|---|
| JP | 084554 | A | 1/1996 |
| JP | 0868537 | A | 3/1996 |
| JP | 11316175 | A | 11/1999 |
| JP | 2005226893 | A | 8/2005 |
| JP | 2008169835 | A | 7/2008 |

OTHER PUBLICATIONS

Unofficial English translation of Office Action issued in connection with corresponding JP Application No. 2010-001627 on Oct. 15, 2013.

* cited by examiner

OPTICAL FLAME HOLDING AND FLASHBACK DETECTION

BACKGROUND OF THE INVENTION

The subject matter disclosed herein relates to gas turbines and more particularly to optical flame holding and flashback detection.

In a gas turbine, fuel is burned with compressed air, produced by a compressor, in one or more combustors having one or more fuel nozzles configured to provide a premixing of fuel and air in a premixing zone located upstream of a burning zone (main combustion zone). Damage can quickly occur to the combustor when flame holding or flashback occurs in its fuel/air premixing passages. During desirable operation of the combustor, the premixed fuel and air combust downstream of the fuel/air premixing passages in the combustion zone. During flame holding or flashback, the fuel and air mixture in the premixing passages combusts. The flashback condition generally occurs when a flame travels upstream from the main burning zone into the premixing zone, which is not intended to sustain combustion reactions. As a consequence, serious damage may occur to the combustion system, potentially resulting in a catastrophic malfunction of the system and a concomitant substantial financial loss.

The use of ion-sensing detectors and other devices, such as thermocouples and fiber optics, to detect flashback is well known. However, these detectors simply detect the presence of a flame and do not discriminate the type of flame within the combustion system.

It is therefore desirable to provide a combustor with a flame detection system configured to discriminate flame types and arrest the flame holding or flashback event.

BRIEF DESCRIPTION OF THE INVENTION

According to one aspect of the invention, a combustor is provided. The combustor includes a combustor housing defining a combustion chamber having combustion zones and flame detectors disposed on the combustor housing and in optical communication with the combustion chamber. The flame detectors are configured to detect an optical property related to one or more of the combustion zones.

According to another aspect of the invention, a gas turbine is provided. The gas turbine includes a compressor configured to compress ambient air. The gas turbine further includes a combustor in flow communication with the compressor, the combustor being configured to receive compressed air from the compressor assembly and to combust a fuel stream to generate a combustor exit gas stream. The combustor includes a combustor housing defining a combustion chamber having combustion zones and flame detectors disposed on the combustor housing and in optical communication with the combustion chamber. The flame detectors are configured to detect an optical property related to one or more of the combustion zones.

According to yet another aspect of the invention, a method of operating a combustor is provided. The method includes introducing fuel and air within a premixing device, forming a gaseous pre-mix, and combusting the gaseous pre-mix in a combustion chamber, thereby generating a flame type. The method further includes monitoring the flame type to determine the presence of flame holding within the combustion chamber.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

Figure 1:
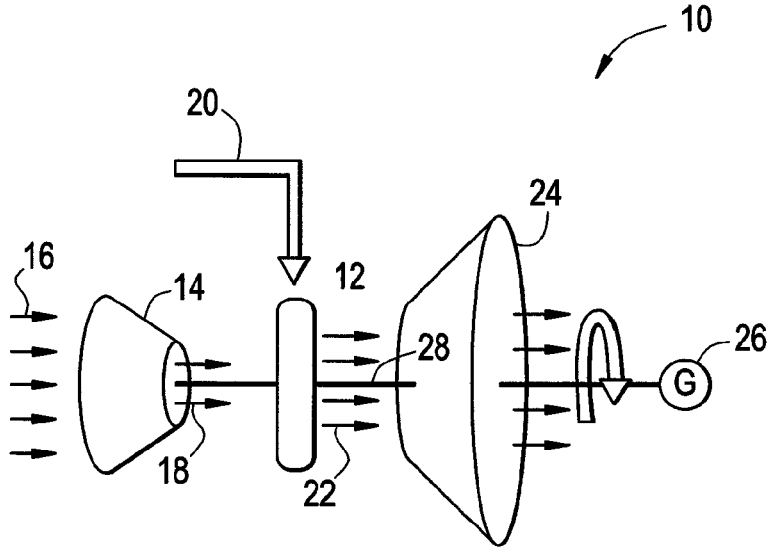
FIG. 1 is a diagrammatical illustration of a gas turbine system in accordance with exemplary embodiments.

The detailed description explains embodiments of the invention, together with advantages and features, by way of example with reference to the drawings.

DETAILED DESCRIPTION

In exemplary embodiments, the systems and methods described herein detect flame holding/flashback in gas turbine combustors to inhibit damage to the engine hardware and for any approach to actively stop the flame holding event. Optical flame detection is implemented in Dry-Low NOx (DLN) units using a detector with a response to ultraviolet emission lines. The SiC solid state flame detector more recently utilized has a responsivity envelope that includes emission sensitivity to wavelengths between about 200 nm and 430 nm. This in contrast to a Geiger Muller tube that responds to only the shorter wavelength region below about 250 nm. The most intense emission at about 300 nm is produced by the excited OH molecule which is a direct product of the combustion process. Because of the SiC photodiodes responsivity characteristics it is not very sensitive to combustor hot wall blackbody radiation or 350 to 450 nm radiation from soot. Excessive radiation from soot is an indication of a diffusion flame in contrast to a flame resulting from a premixing of air and fuel prior to combustion (a premixed flame). When combustion occurs, as indicated by an optical detection of emission lines, the gas turbine continues to operate with expected optimum operating conditions. Premixed flames are desirable because they allow for lower firing temperatures, which for instance are desirable for reducing undesirable emissions into the atmosphere using DLN combustors. If a flame holding/flashback event occurs, as indicated by an optical detection of soot emission lines, the flame detection system can take action such as reducing or eliminating fuel flow into the combustor to prevent damage to the gas turbine. As such, during a flame holding/flashback event in the fuel nozzle additional photoemissions from thermal soot emissions or other richer flame species are measured. While current flame detectors have a broad enough response curve to detect a diffusion flame a two or multi-color detection system that can separately detect the presence of combustion (e.g. OH band emission) and soot emissions would enable the discrimination of flame types. In further exemplary embodiments, the flame detectors described herein can detect thermal emissions from the fuel nozzles. By monitoring the thermal emissions from the fuel nozzles, the system can determine if a flame is within the fuel nozzle because the thermal emissions would indicate a higher temperature than would be expected in the fuel nozzles. For example, thermal emissions indicating flame holding/flashback could be measured at the swirler vanes, burner tube, or diffusion tip of the fuel nozzles or other downstream components. As such, increased photoemissions from a flame holding/flashback event are measured in the combustor to determine if flame holding/flashback is occurring within the fuel nozzle using one or multiple color detectors. An increase in thermal emissions from the fuel nozzle components could be implemented to detect flame holding within the fuel nozzle.

As discussed in detail herein, exemplary embodiments function to detect enhance flame holding/flashback in combustors such as in combustors employed in gas turbines. In particular, exemplary embodiments include a flame detection system and method configured to detect flame holding/flashback in a gas turbine combustion chamber and to take appropriate action to prevent damage to the gas turbine. Turning now to the drawings and referring first to FIG. 1 a gas turbine 10 having a combustor 12 is illustrated. The gas turbine 10 includes a compressor 14 configured to compress ambient air 16. The combustor 12 is in flow communication with the compressor 14 and is configured to receive compressed air 18 from the compressor 14 and to combust a fuel stream 20 to generate a combustor exit gas stream 22. In addition, the gas turbine 10 includes a turbine 24 located downstream of the combustor 12. The turbine 24 is configured to expand the combustor exit gas stream 22 to drive an external load such as a generator 26. In the illustrated embodiment, the compressor 14 is driven by the power generated by the turbine 24 via a shaft 28. The combustor 12 employs a flame detection device configured to detect flame holding/flashback in a gas turbine combustion chamber and to take appropriate action to prevent damage to the gas turbine 10.

Figure 2:
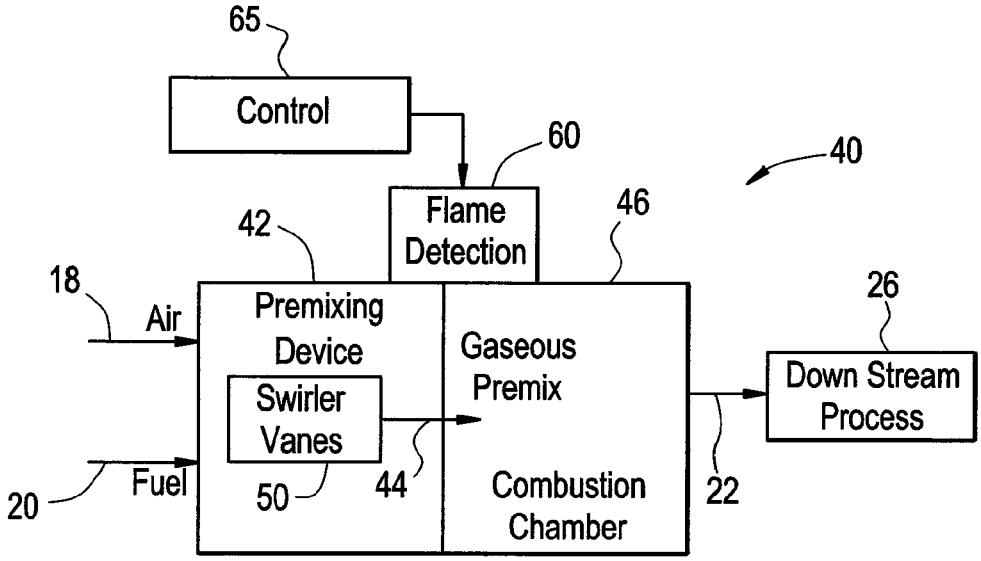
FIG. 2 is a diagrammatical illustration of a combustor having a premixing device employed in the gas turbine system of FIG. 1 in accordance with exemplary embodiments.

FIG. 2 is a diagrammatical illustration of an exemplary configuration 40 of the combustor 12 having a flame detection device 60 employed in the gas turbine system 10 of FIG. 1 in accordance with exemplary embodiments. As illustrated, the combustor 40 includes the premixing device 42 configured to mix fuel 20 and air 18 to form a gaseous pre-mix 44. Further, the combustor 40 includes a combustion chamber 46 configured to combust the pre-mix fuel 44 to form the combustor exit gas stream 22. Further, the combustor exit gas stream 22 is directed to a downstream process 48 such as to the turbine 24 (see FIG. 1) for driving the external load 26 (see FIG. 1). The premixing device 42 can further include a plurality of swirler vanes 50 configured to provide a swirl movement to the fuel 20 and/or air 18 to facilitate mixing of the fuel 20 and air 18. In exemplary embodiments, the combustor 40 further includes the flame detection device 60, which can be coupled to and in communication with either or both of the premixing device 42 and the combustion chamber 46. It is appreciated that when the flame detection device 60 is configured to detect soot production and diffusion flames, as evidenced by flames having particular optical properties within the combustion chamber, the flame detection device is coupled to and in optical communication with the combustion chamber 46. However, if the flame detection device 60 is configured to detect thermal emissions from fuel nozzle hardware surface, then the flame detection device 60 is coupled to and in optical communication with the pre-mixing device, proximate the fuel nozzle hardware under detection. The combustor 40 can further include a control unit 65 coupled to the flame detection 60. The control unit 65 is configured to receive signals from the flame detection that correspond to the flame type present in the combustion chamber 46. The control unit 65 is further in communication with the source of the air 18 and the fuel 20. As further described herein, if the control unit 65 receives signals that indicate there is flame holding/flashback in the combustion chamber 46, the control unit 65 can take appropriate action to mitigate damage to the gas turbine. The appropriate action that the control unit 65 can take includes ceasing fuel and air flow to the combustion chamber or some modification of the air and fuel flow to reduce or eliminate the flame holding/flashback.

Figure 3:
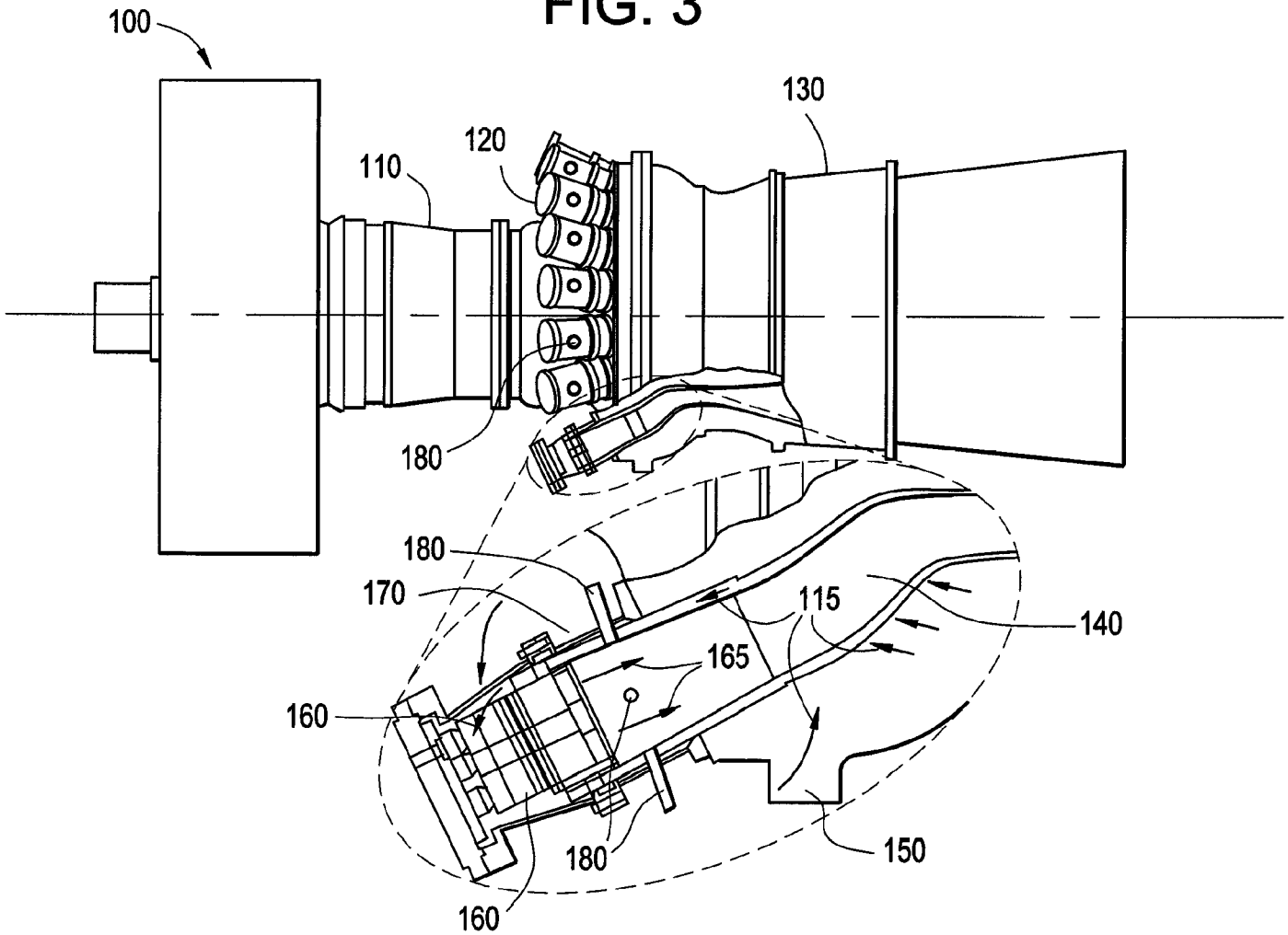
FIG. 3 diagrammatically illustrates a gas turbine 100 in accordance with exemplary embodiments.

FIG. 3 diagrammatically illustrates an example of a gas turbine 100 including a plurality of flame detectors 180 in accordance with exemplary embodiments. The example of the gas turbine illustrates the flame detectors coupled to and in optical communication with a combustion chamber 140 of the gas turbine and configured to detect the wavelengths of several flame types within the combustion chamber 140.

Similar to FIG. 1, the gas turbine 100 includes a compressor 110 configured to compress ambient air. One or more combustor cans 120 are in flow communication with the compressor 110 via a diffuser 150. The combustor cans 120 are configured to receive compressed air 115 from the compressor 110 and to combust a fuel stream from fuel nozzles 160 to generate a combustor exit gas stream 165 that travels through a combustion chamber 140 to a turbine 130. The turbine 130 is configured to expand the combustor exit gas stream 165 to drive an external load. The combustor cans 120 include an external housing 170, which includes a series of flame detectors 180 affixed to the housing 170. The flame detectors 180 are coupled to and in optical communication with the combustion chamber 140 and the combustor exit gas stream 165.

In exemplary embodiments, the series of flame detectors 180 are each configured to detect a particular wavelength. As such, the combustor cans 120 include multiple flame detectors configured to detect photoemissions at multiple wavelengths. For example, the combustor cans 120 may each include three flame detectors 180, as illustrated. One detector includes a spectral response that peaks closest to the wavelength of a hydrocarbon flame (approximately 306 nm). A second detector can include a spectral response that peaks closes to the wavelength of soot from diffusion (approximately 380 nm). A third detector can include a spectral response that peaks closest to the wavelength of soot from pre-mixed fuel and non-pre-mixed fuel in an undesirable combustion zone from CO—O recombination reaction (approximately 400 nm). However, it is appreciated that since the wavelengths for both soot from diffusion and soot from undesirable pre-mix combustion are relatively close to one another such that a single detector having a spectral response that peaks in the approximate region of 350 nm to 450 nm can be implemented for flame holding/flashback events that generate both types of soot. As such, each of the series of flame detectors 180 can include a spectral response that peak at differing wavelengths.

It is appreciated that the flame detectors 180 can be configured in a variety of ways to be configured to detect the multiple wavelengths of multiple flame types to discriminate the flame types. It is well known the spectral response of optical detectors (e.g., photodiodes) is primarily determined by the band gap voltage of the material used in the optical detectors. SiC has a band gap voltage of 3.1 volts and has a spectral response that peaks at about 270 nm and has a wavelength limit if about 400 nm. SiC detectors are currently in use for detection of flames in combustion chambers of gas turbines.

Figure 4:
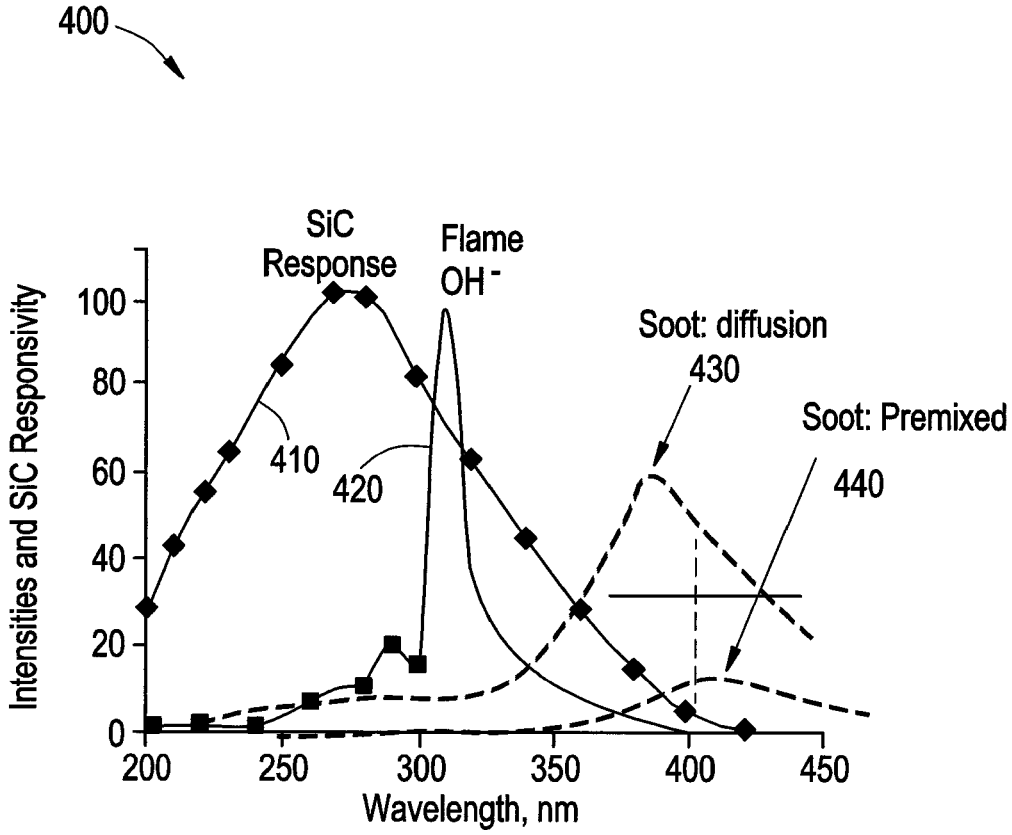
FIG. 4 illustrates a plot of relative spectral response of the flame detectors 180 versus wavelength of the flame type.

FIG. 4 illustrates a plot 400 of the relative spectral characteristics of the flame emissions versus wavelength of various flame types. A SiC responsivity curve 410 is illustrated. An emission characteristic curve 420 of a premixed hydrocarbon flame with an expected OH— emission spectral peak at about 306 nm is also illustrated. Currently, a SiC detector is implemented for detection of a hydrocarbon flame, which suitably detects the flame. However, it is appreciated that the relative spectral response is about 70% of the maximum at 306 nm. For current systems, the 70% relative spectral response is acceptable for simple hydrocarbon flame detection. FIG. 4 further illustrates an optical spectral emission curve 430 for soot produced by a diffusion flame and a spectral curve 440 for soot due to premixed fuel burning in the combustion chamber 140 (see FIG. 3) based on a typical premixed combustor flame temperature. It is appreciated that the spectral intensity versus characteristics wavelength changes and shifts as a function of local flame temperature. As such, the spectral characteristics described in the example of FIG. 4 is illustrative and other spectral characteristics are contemplated in other exemplary embodiments. It is further appreciated that currently implemented SiC detectors have a lower spectral responsivity for wavelengths between 380 nm and 400 nm that are associated with the diffusion soot and the premix soot flame optical emissions intensities respectively, as described above. In exemplary embodiments, a first of the detectors 180 can include a spectral response that occurs at or near the spectral peak of the wavelength (about 306 nm) of a hydrocarbon flame, can be coupled to the combustion chamber 140. A second of the detectors 180 can include a spectral response that occurs at or near the peak of a wavelength (about 380 nm) of a flame due to diffusion soot. A third of the detectors 180 can include a spectral response that occurs at or near the peak of a wavelength (about 400 nm) of a flame due to premix soot. As discussed above, since the emission spectra due to diffusion and premix soot flames are relatively close, a single detector having a spectral peak that occurs at or near an average peak of the two soot flames, can be implemented. It is appreciated that since the wavelengths of the spectral peaks of the soot flames are both longer than the peak wavelength of the hydrocarbon flame, the hydrocarbon flame can be adequately discriminated from the soot flames using existing or modified detectors. In exemplary embodiments, the material of the detectors 180 can be fabricated (e.g., by adjusting the band gap voltage via doping of the material) such that the spectral peaks occur closest to the spectral peaks of the respective flame types. Furthermore, the material can be further fabricated to bring the upper and lower wavelength limits closer to the spectral peak, this creating a narrow peak at the spectral peak of wavelength of the respective flame type. It is appreciated that modification of a SiC detector can further be modified (e.g., via doping) to shift the spectral peak of the SiC detector closer to 306 nm to better correspond with the spectral peak of the hydrocarbon flame.

Figure 5:
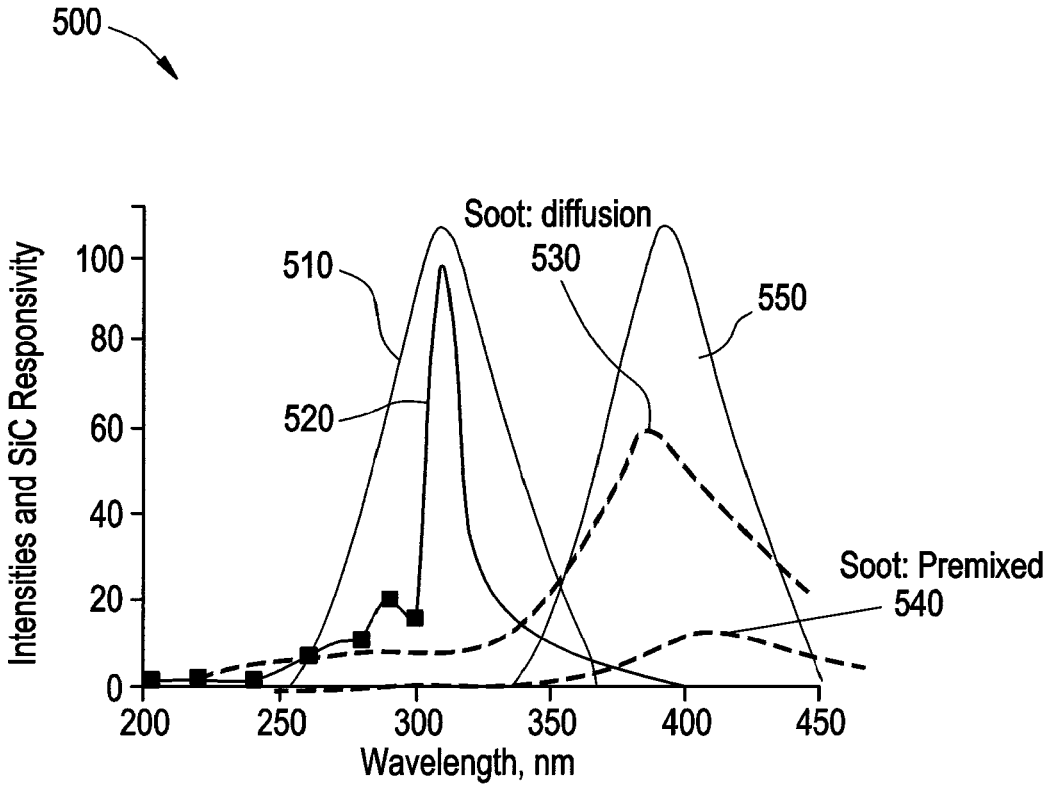
FIG. 5 illustrates a plot of relative spectral response of the flame detectors 180 versus wavelength of the flame type.

FIG. 5 illustrates a plot 500 of relative spectral response of the flame detectors 180 versus wavelength to accomplish the goals described herein. In the plot 500, a first detector spectral response of a SiC flame detector 180 that has been modified to have a spectral responsivity overlapping the spectral peak of OH in a hydrocarbon flame (e.g., 306 nm), is shown by curve 510. Furthermore a second detector spectral response curve 550 corresponds to a flame detector 180 that has been configured to have a spectral peak corresponding to the thermal emission spectral peaks of one or both of the diffusion soot and premix soot, as shown by curves 530 and 540 (approximately 380 nm and 400 nm respectively). In this example, the response curve 510 has a lower limit of about 250 nm and an upper limit of about 360 nm. The response curve 550 has a lower limit from about 340 nm and an upper limit from about 450 nm. Each of the detector response curves 510, 550 both have a width of about 100 nm. The lower and upper limits and widths are shown to illustrate that there is little to no overlap of the spectral responses of the flame detectors 180 for each individual flame types. As such, the detector configured to detect the hydrocarbon flame has little to no response in the spectral region for the soot flames. Similarly, the detector configured to detect the soot flames has little to no response in the spectral region for the hydrocarbon flame. It is appreciated that the upper and lower limits and the width described above are for illustrative purposes only and that other lower and upper limits and widths are contemplated in other exemplary embodiments.

In exemplary embodiments, the flame detectors 180 can be of a single material type having a lower limit below the spectral peak for hydrocarbon flames and an upper limit above the spectral peak for the soot flames. In this way a single detector type may be implemented to detect both flames types. The individual flame detectors can further include optical filters such that a flame detector used for the hydrocarbon flame can filter the wavelengths for the soot flames and the flame detector for the soot flames can filter the wavelength for the hydrocarbon flame. For instance the first detector's responsivity (510) can be accomplished by placing an optical bandpass filter either on a SiC photodiode chip or as a layer on the optical window of the SiC photodiode package. The advantage of using SiC is that it is already relatively unresponsive to wavelengths above about 380 nm which makes the filter relatively easy to design and implement. One choice for a detector with responsivity 550 would be a Silicon photodiode covered with a phosphor to increase its sensitivity in the violet and near ultraviolet region. Unfortunately the silicon photodiode has a responsivity that extends to lower wavelengths as far as the infrared region (1000 nm) so blackbody and visible radiation can blind it easily. The bandpass filter required to accomplish responsivity 550 would therefore be difficult to design and fabricate. An alternative method would be to use an optical fiber connected to a CCD spectrometer. This device would scan the entire emission spectrum from 250 to 450 nm and signal processing software programming would enable a rapid and continuously scan of the signal strengths between the two spectral regions described above.

In exemplary embodiments, the control unit 65 can detect the signal responses from multiple detectors (e.g., the flame detectors 180) and implement a voting algorithm to determine the type of action taken by the control unit 65 in response to a flame holding/flashback condition. For example, if two of the three detectors 180 determine that a flashback condition exists, the control unit 65 can then cut off or reduce the fuel to the combustor cans 120. Similarly, if only one flame detector 180 detects flashback, the control unit 65 can decide to continue the fuel until the flame detectors 180 make another reading. Furthermore, multiple detector elements can reside in an enclosure corresponding to the flame detectors 180. The multiple detector elements can be multiplexed in order to aggregate the signals detected in the combustor cans 120. In this way, the aggregate signal can be implemented to determine the results of the voting algorithm.

Figure 6:
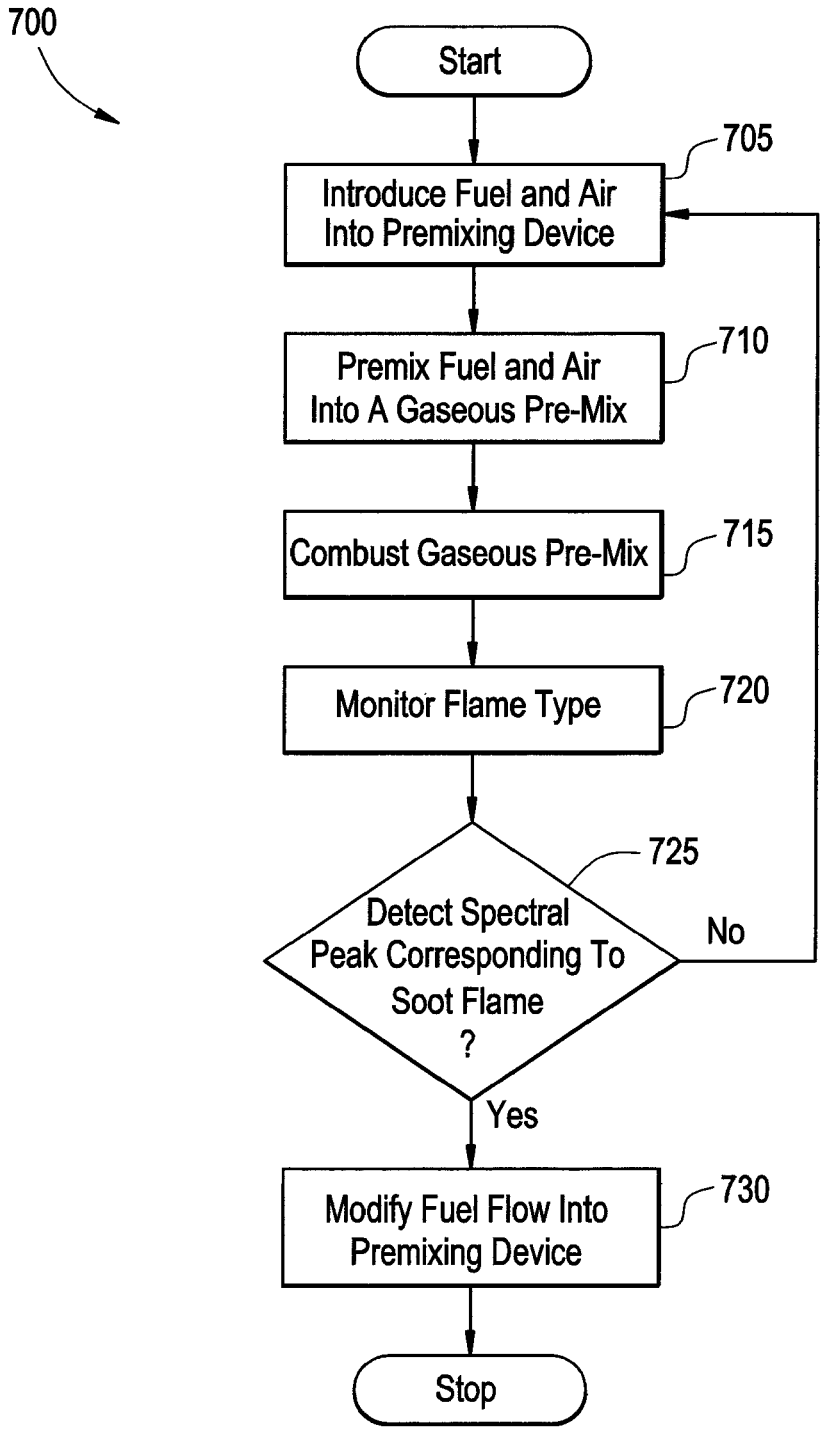
FIG. 6 illustrates a flow chart of a method for operating a combustor in accordance with exemplary embodiments.

FIG. 6 illustrates a flow chart of a method for operating a combustor in accordance with exemplary embodiments. At block 705, fuel nozzles (e.g., 160 FIG. 3) introduce fuel into a premixing device (e.g., 42 FIG. 2) and a compressor (e.g., 110 FIG. 3) introduces air into the premixing device. At block 710, the premixing device forms a gaseous pre-mix. At block 715, the combustor (e.g., combustor cans 120 FIG. 3) combust the premix in a combustions chamber (e.g., 140 FIG. 3). At block 720, the flame type within the combustion chamber is monitored. At block 725, the flame detectors can monitor spectral peaks of the flame types in the combustion chamber. If the flame detectors detect a spectral peak that corresponds to a soot flame, then at block 730, the controller can modify the fuel flow into the premixing device or other appropriate action described herein. In the flame detectors do not detect a spectral peak corresponding to a soot flame or simply detect a normal hydrocarbon flame, then the process can continue at block 705.

Figure 7:
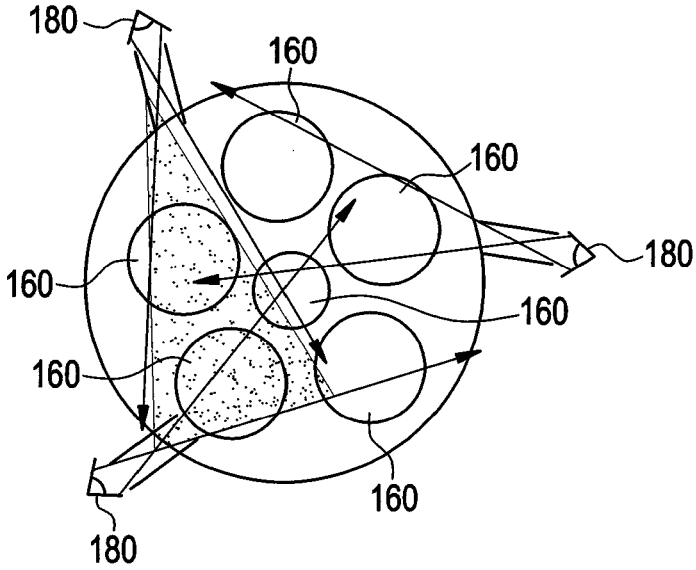
FIG. 7 illustrates a front view of the combustor can of FIG. 3.

Exemplary embodiments have been described for detecting flame holding/flashback in the combustion chamber 140 of the combustor cans 120. As described herein, the exemplary embodiments can also be implemented to detect thermal emissions from the fuel nozzles 160. By monitoring the thermal emissions from the fuel nozzles 160, the system can determine if a flame is within the fuel nozzle 160 because the thermal emissions would indicate a higher temperature than would be expected in the fuel nozzles 160. For example, thermal emissions indicating flame holding/flashback could be measured at the swirler vanes, burner tube, or diffusion tip of the fuel nozzles 160 or other downstream components. As such, increased photoemissions from a flame holding/flashback event are measured in the combustor cans 120 to determine if flame holding/flashback is occurring within the fuel nozzle 160 using one or multiple color detectors (e.g., the flame detectors 180). An increase in thermal emissions from the fuel nozzle 160 components could be implemented to detect flame holding within the fuel nozzle 160. In one example, combustion can occur inside the fuel nozzle 160. The result can be soot thermal optical radiation or thermal emissions from the fuel nozzle components, which are exposed to the hot flame and would radiate unexpected thermal emissions. In exemplary embodiments, the flame detectors 180 can be oriented adjacent the fuel nozzles 160 as described above in order to detect thermal emissions form the fuel nozzles 160. The control unit 65 (See FIG. 2) can then receive the signals from the flame detectors 80 and take appropriate action. For example, the control unit 65 can implement triangulation to detect even location and aid in root cause diagnostics. FIG. 7 illustrates a front view of the combustor can of FIG. 3. The flame detectors 180 are oriented adjacent the fuel nozzles 160 or fuel nozzle circuit. Fuel from the premixed circuit could be redirected in the full or part to another fuel circuit, vented or unused fuel circuit such as the diffusion flame circuit. Furthermore, the flame detectors 180 are spaced such that each flame detector 180 shares a line of sight with one of the fuel nozzles 160. As such, if two of the flame detectors indicate that there is a flame holding/flashback event, the control unit 65 therefore knows which of the fuel nozzles 160 is affected. In this way, the controller can selectively reduce the fuel or shut off the fuel to the one effected fuel nozzle 160. It is appreciated that the combustor can 120 can experience minimal disruption when the control unit 65 acts upon only a single fuel nozzle 160. As such, the affected fuel nozzle 160 can be serviced during the next scheduled outage. It is appreciated that triangulation is only one example of how the flame detectors 180 can be implemented to detect thermal emission from the fuel nozzles 160 during a flame holding/flashback event. Other detection implementations are contemplated in other exemplary embodiments.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor, comprising:

a combustor housing defining a combustion chamber having a plurality of combustion zones;

a plurality of flame detectors disposed on the combustor housing and in optical communication with the combustion chamber, wherein a subset of the plurality of flame detectors is configured to detect an optical property related to a hydrocarbon flame type, with a wavelength of about 300 nanometers (nm) and another subset of the plurality of flame detectors is configured to detect an optical property related to a soot flame type that is a direct product of a combustion process, with a wavelength in the range of about 350 nm to about 450 nm; and a processor configured to determine from the detected optical properties of the hydrocarbon flame type and the soot flame type a presence of the at least one of the flame holding condition and the flashback condition in the one or more of the plurality of combustion zones.

2. The combustor as claimed in claim 1 wherein the optical property is a wavelength of a flame type.

3. The combustor as claimed in claim 2 wherein the flame type is a hydrocarbon flame.

4. The combustor as claimed in claim 2 wherein the flame type is a soot flame.

5. The combustor as claimed in claim 1 wherein one of the plurality of flame detectors includes a spectral response peak proximate a hydrocarbon flame spectral response peak.

6. The combustor as claimed in claim 5 wherein another of the plurality of flame detectors includes a spectral response peak proximate a soot flame spectral response peak, for at least one of soot from diffusion and soot from pre-mixed fuel and non-pre-mixed fuel.

7. The combustor as claimed in claim 1 wherein the plurality of flame detectors is configured to detect a plurality of flame types.

8. A gas turbine, comprising:

a compressor configured to compress air;

a combustor in flow communication with the compressor, the combustor being configured to receive compressed air from the compressor assembly and to combust a fuel stream to generate a combustor exit gas stream; the combustor comprising:

a combustor housing defining a combustion chamber having a plurality of combustion zones;

a plurality of flame detectors disposed on the combustor housing and in optical communication with the combustion chamber, wherein a subset of the plurality of flame detectors is configured to detect an optical property related to a hydrocarbon flame type, with a wavelength of about 300 nanometers (nm) and another subset of the plurality of flame detectors is configured to detect an optical property related to a soot flame type that is a direct product of a combustion process, with a wavelength in the range of about 350 nm to about 450 nm; and a processor configured to determine from the detected optical properties of the hydrocarbon flame type and the soot flame type a presence of the at least one of the flame holding condition and the flashback condition in the one or more of the plurality of combustion zones.

9. The gas turbine as claimed in claim 8 wherein the optical property is a wavelength of a flame type.

10. The gas turbine as claimed in claim 9 wherein the flame type is at least one of hydrocarbon fuels and non-hydrocarbon containing fuels.

11. The gas turbine as claimed in claim 9 wherein the flame type is a soot radiation.

12. The gas turbine as claimed in claim 8 wherein one of the plurality of flame detectors includes a spectral response peak proximate a hydrocarbon flame spectral response peak containing hydrocarbon fuel constituents.

13. The gas turbine as claimed in claim 12 wherein another of the plurality of flame detectors includes a spectral response peak proximate a soot flame spectral response peak, for at least one of soot from diffusion and soot from pre-mixed fuel and non-pre-mixed fuel.

14. The gas turbine as claimed in claim 8 wherein the plurality of flame detectors is configured to detect a plurality of flame types.

15. A method of operating a combustor, the method comprising:

introducing fuel and air within a premixing device;

forming a gaseous pre-mix;

combusting the gaseous pre-mix in a combustion chamber, thereby generating a flame type;

monitoring the flame type using a subset of a plurality of flame detectors configured to detect an optical property related to a hydrocarbon flame type, with a wavelength of about 300 nanometers (nm), and another subset of the plurality of flame detectors configured to detect an optical property related to a soot flame type that is a direct product of a combustion process, with a wavelength in the range of about 350 nm to about 450 nm; and using a processor to determine from the detected optical properties of the hydrocarbon flame type and the soot flame type a presence of the at least one of the flame holding condition and the flashback condition in the combustion chamber.

16. The method as claimed in claim 15 wherein monitoring the flame type to determine the presence of flame holding within the combustion chamber, comprises:

detecting the presence of a spectral peak corresponding to a hydrocarbon flame; and detecting the presence of a spectral peak corresponding to a soot flame in the combustion chamber, for at least one of soot from diffusion and soot from pre-mixed fuel and non-pre-mixed fuel.

17. The method as claimed in claim 16 further comprising in response to a detection of a soot flame within the combustion chamber, modifying the fuel introduced into the premixing device.

18. The method as claimed in claim 17 wherein modifying the fuel introduced into the premixing device comprises ceasing a fuel flow to nozzles disposed adjacent the combustion chamber.

19. The method as claimed in claim 16 further comprising in response to a detection of a hydrocarbon flame within the combustion chamber, continuing a supply of fuel to fuel nozzles disposed adjacent the combustion chamber.

20. The method as claimed in claim 16 further comprising in response to a detection of a hydrocarbon flame and a soot flame within the combustion chamber, modifying the fuel introduced into the premixing device.

* * * * *